United States Patent [19]

Hosoi et al.

[11] 3,984,305

[45] Oct. 5, 1976

[54] PROCESS FOR PRODUCING LOW SULFUR CONTENT FUEL OILS

[75] Inventors: Takuji Hosoi; Tadaaki Kato; Yukuo Katayama; Kazuaki Matsui; Tsutomu Konno, all of Tokyo, Japan

[73] Assignee: Kureha Kagaku Kogyo Kabushiki Kaisha, Tokyo, Japan

[22] Filed: Apr. 12, 1974

[21] Appl. No.: 460,653

[30] Foreign Application Priority Data

Apr. 12, 1973 Japan ..... 48-40840

[52] U.S. Cl. ..... 208/57; 208/61; 208/89; 208/97; 208/130

[51] Int. Cl.[2] ..... C10G 37/06

[58] Field of Search ..... 208/50, 57, 58, 61, 208/97, 89

[56] References Cited

UNITED STATES PATENTS

| | | | |
|---|---|---|---|
| 2,871,182 | 1/1959 | Weekman | 208/50 |
| 3,617,481 | 11/1971 | Voorhies et al. | 208/50 |
| 3,720,729 | 3/1973 | Sze et al. | 208/57 |
| 3,730,875 | 5/1973 | Gleim et al. | 208/61 |
| 3,773,653 | 11/1973 | Nongbri et al. | 208/58 |
| 3,775,294 | 11/1973 | Peterson et al. | 208/50 |
| 3,781,195 | 12/1973 | Davis et al. | 208/57 |

*Primary Examiner*—Herbert Levine
*Attorney, Agent, or Firm*—Sughrue, Rothwell, Mion, Zinn and Macpeak

[57] ABSTRACT

A process for producing a low sulfur content fuel oil in a high yield from a starting oil having a high sulfur content, which comprises (1) treating a residual petroleum oil with hydrogen at a temperature of about 350° to 450°C and a pressure of about 50 to 200 Kg/cm² at a liquid hourly space velocity of about 0.2 to 4 *l*/H.*l* in the presence of a catalyst, (2) introducing an inert gas or steam at a temperature of about 400° to 900°C and pyrolyzing the treated oil at a temperature of about 350° to 500°C and at a pressure of about atmospheric pressure to 100 Kg/cm² with a residence time of about 0.5 to 10 hours, and (3) hydrodesulfurizing the pyrolyzed oil at a temperature of about 300° to 400°C and a pressure of about 30 to 100 Kg/cm² at a liquid hourly space velocity of about 0.5 to 4 *l*/H.*l* in the presence of a desulfurizing catalyst.

3 Claims, 1 Drawing Figure

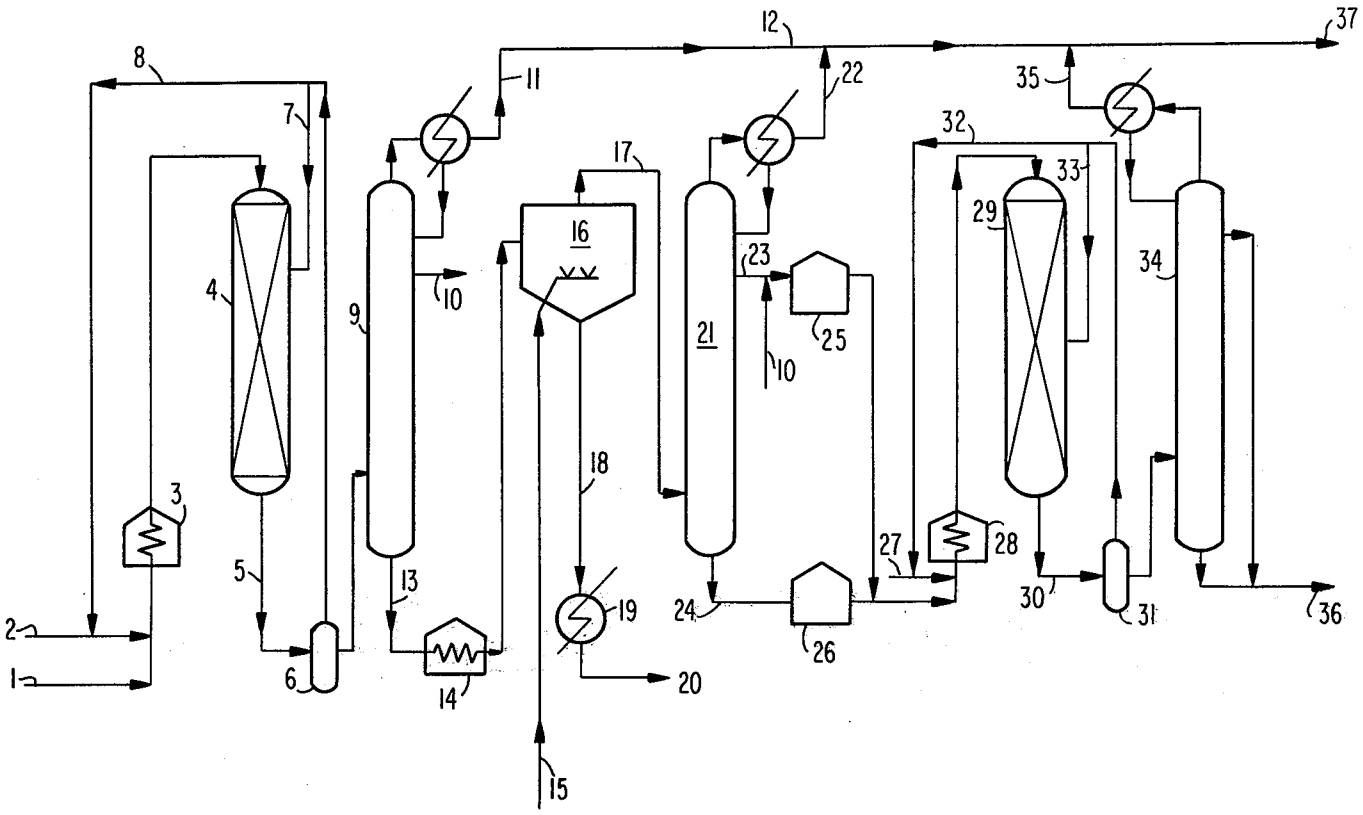
37
36
34
31
35
33
30
29
28
32
27
22
25
26
12
23
10
21
24
20
17
16
18
19
15
11
10
14
13
9
7
6
5
4
3
8
2
1

PROCESS FOR PRODUCING LOW SULFUR CONTENT FUEL OILS

BACKGROUND OF THE INVENTION 1. FIELD OF THE INVENTION

This invention relates to a process for producing a low sulfur content fuel oil in a high yield by three steps of (1) a hydrogen treatment, (2) a pyrolysis treatment, and (3) a desulfurizing treatment.

2. DESCRIPTION OF THE PRIOR ART

In recent years, a rapidly increasing demand for fuel oils having a low sulfur content has existed in order to prevent environmental pollution. With a view toward providing low sulfur content fuel oils, an indirect desulfurizing method and a direct desulfurizing method have been employed, but neither of these methods has ever proved entirely satisfactory. Since the indirect desulfurizing method comprises removing asphalt from a vacuum distillation oil or a residual oil, desulfurizing the resulting oil, and mixing the desulfurized oil with a vacuum distillation residual oil, the sulfur content of the mixed fraction is naturally restricted. On the other hand, the direct desulfurizing method is a hydrodesulfurizing method at high temperatures and pressures, and therefore, many problems remain to be solved from the standpoint of chemical engineering and the method is not economically feasible. Economically, it is extremely difficult to use these methods to treat high sulfur content crude oils occurring in Khafji or Kuwait to form fuel oils having a sulfur content of not more than 1%. Accordingly, development of methods has been desired for producing low sulfur fuel oils which conform to the pollution control regulations that will become more rigorous in the future in order to prevent environmental pollution.

SUMMARY OF THE INVENTION

These difficulties have been completely overcome by the present invention which provides a process for producing fuel oils having a sulfur content of not more than about 0.3% by weight from a residual oil of a high sulfur content crude oil, such as those occurring in Middle East Asia such as Khafji, or Kuwait, very easily in a high yield.

Accordingly, this invention provides a process for preparing a low sulfur content fuel oil in a high yield, which comprises:

1 treating a residual petroleum oil with hydrogen at a temperature of about 350° to 450°C and a pressure of about 50 to 200 Kg/cm² at a liquid hourly space velocity of about 0.2 to 4 *l*/H·*l* in the presence of a catalyst, 2 pyrolyzing the treated oil by introducing an inert gas or steam at a temperature of about 400° to 900°C, and pyrolyzing the treated oil at a temperature of about 350° to 500°C and a pressure of about atmospheric pressure to 100 Kg/cm² with a residence time of about 0.5 to 10 hours, and 3. hydrodesulfurizing the pyrolyzed oil at a temperature of about 300° to 400°C and a pressure of about 30 to 100 Kg/cm² at a liquid hourly space velocity of about 0.5 to 4 *l*/H·*l* in the presence of a desulfurizing catalyst.

BRIEF DESCRIPTION OF THE ACCOMPANYING DRAWING

The drawing is a flow sheet of one embodiment of the process of this invention.

DETAILED DESCRIPTION OF THE INVENTION

The steps in the process of this invention are described below in greater detail.

The desulfurizing step (3rd step) is performed by the indirect desulfurizing method now in commercial practice. The catalyst used in this step is usually a catalyst comprising nickel-molybdenum, cobalt-molybdenum, or nickel-cobalt-molybdenum supported on a carrier such as alumina having a low decomposing activity. The cobalt-molybdenum/alumina system is most commonly used.

Therefore, a characteristic feature of this invention lies in that the third step, in which previously only an asphalt-removed fraction could be used according to the prior techniques, is combined with the first and second steps making it unnecessary to perform an asphalt-removing operation.

The reaction temperature in the third step generally is about 300° to 400°C. If the reaction temperature is below about 300°C, the rate of reaction is so slow that the reaction hardly proceeds, and if the reaction temperature is above about 400°C, a decomposition reaction proceeds during the desulfurization reaction to render the oil more volatile. This is of course not desirable. The reaction pressure is about 30 to 100 Kg/cm². If the pressure is lower than about 30 Kg/cm², the concentration of hydrogen in the liquid is low, and it is difficult to perform the reaction. On the other hand, if the reaction pressure is higher than about 100 Kg/cm², the process is undesirable from the standpoint of equipment and economy. The liquid hourly space velocity is about 0.5 to 4 *l*/H. *l*. If the liquid hourly space velocity is less than about 0.5, a decomposition and a coking of the oil tend to occur, and if the liquid hourly space velocity is above about 4, sufficient time for reaction is not obtained.

The second step of pyrolysis in the present invention is similar to a delayed coking method for producing petroleum cokes from a petroleum residual oil, and to the process for producing paraffinic oils and high aromatic pitches as disclosed in U.S. patent application Ser. No. 240,619 filed on Apr. 3, 1972 now abandoned.

It has been found that the catalytic hydrogen treatment (first step) of the starting residual oil makes it possible to minimize the formation of pitches in the second step.

In the second step, the temperature of the inert gas or steam is about 400°to 900°C. If the temperature is lower than about 400°C, a large quantity of gas is required in order to provide the heat required for the pyrolysis. If the temperature is higher than about 900°C, the amount of the gas decreases because of the heat of pyrolysis, and the desired quality and yield cannot be obtained. The reaction temperature is about 350° to 500°C. If the reaction temperature is lower than about 350°C, the desired reaction scarcely proceeds, and if it is higher than about 500°C, coking takes place predominately. The reaction pressure suitably used ranges from about normal atmospheric pressure to about 100 Kg/cm². If the reaction pressure is higher than about 100 Kg/cm², a polycondensation reaction proceeds to lower the yield of the oil, and if it is lower than about atmospheric pressure, the reaction takes place at reduced pressure when the gas is introduced. This is not advantageous. The residence time is generally about 0.5 to 10 hours. If the residence time is shorter than about 0.5 hour, high temperatures are required to increase the rate of reaction, which may result in coking within the reaction system. If the residence time is longer than about 10 hours, coking takes place within the reaction system because of the high temperatures, making it difficult to obtain the desired quality and yield and perform the operation in a stable manner.

The first-step treatment in the process of this invention can be performed in the same manner as in hydrogen treatments generally employed. The catalyst is a catalyst comprising a metal of Groups II, VI, VII, or VIII of the periodic table or an oxide or sulfide of these metals, or such a metal or metal compound supported on a carrier such as diatomaceous earth, alumina, bauxite, pumice, silica-alumina, or activated carbon. For example, a cobalt-molybdenum/alumina catalyst, a cobalt-molybdenum-nickel/alumina catalyst, and a platinum/alumnina catalyst are usually employed.

The reaction temperature in the first step is generally about 350° to 450°C. If the reaction temperature is lower than about 350°C, the rate of reaction is too low to accelerate the reaction. If the reaction temperature is above about 450°C, coking occurs during the reaction. The reaction pressure is about 50 to 200 Kg/cm$^2$. If the reaction pressure is lower than about 50 Kg/cm$^2$, the concentration of hydrogen in the liquid is low, and the reaction proceeds with difficulty. If the reaction pressure is higher than about 200 Kg/cm$^2$, the process is economically undesirable from the standpoint of the equipment required. The liquid hourly space velocity is about 0.5 to 4. If the liquid hourly space velocity is below about 0.5, a long reaction time is required, and coking tends to occur. If the liquid hourly space velocity is above about 4, it is difficult to complete the reaction.

While the conventional indirect desulfurizing methods have been applied to crude oils from which asphalt has been removed, the indirect desulfurizing step of the process of this invention does not require an asphalt-removing step at all. All of the starting oil, after having been subjected to the hydrogen treatment and the pyrolysis treatment in the first and second steps, can be desulfurized in the third step without any difficulties. In addition, the rate of desulfurization can be at least about 80%.

Thus, according to the process of this invention, fuel oils having a sulfur content as low as not more than about 0.3% by weight can be obtained in a yield of at least about 70% from atmospheric pressure distillation oils or vacuum distillation residual oils of crude oils occurring in Middle East Asia, for example, in Khafji or Kuwait. This means that calculated as the crude oil, at least about 80% by weight, usually at least about 90% by weight, of the crude oil can be converted to low sulfur content fuel oils, and by volume, more than about 100% of the oil can be converted to low sulfur content fuel oils. This result is surprising and unexpected in view of the fact that it is generally considered hopeless to reduce the sulfur content of the above residual oils to not more than about 0.5% even by a direct desulfurizing operation under severe conditions.

One embodiment of this invention will be described by reference to the accompanying drawing which is a flowsheet of the process for preparing a low sulfur content fuel oil in accordance with this invention. It should be understood that this flowsheet is merely illustrative of the one embodiment of this invention, and should not in any way be construed as limiting the invention.

Referring now to the flowsheet in the Figure, a starting oil 1 is mixed with hydrogen (circulating hydrogen 8 and replenishing hydrogen 2), and then pre-heated to about 350° to 450°C in a pre-heating furnace 3. The heated mixture is fed into a reactor 4 packed with a catalyst. In the reactor 4, the reaction temperature is about 350° to 450°C, and the reaction pressure is about 50 to 200 Kg/cm$^2$. The mixture 5 of the reaction product and hydrogen which has left the reactor 4 is passed through a hydrogen remover 6 where the hydrogen is recovered. The hydrogen recovered is recycled through 8 after removing $H_2S$, and a part of the hydrogen is recycled to the reactor 4 as a cooling hydrogen 7. The reaction product leaving the hydrogen-remover 6 is fractionally distilled in a fractional distillation tower 9 into a gas 11 and an oil 10 having a boiling point of not more than about 200°C. The gas 11 flows into a main gas pipe 12, and the oil 10 having a boiling point of not more than about 200°C is passed into an oil tank 25.

On the other hand, a distillation bottom oil 13 is preheated to about 350° to 500°C in a pre-heating furnace 14 and then supplied to a pyrolysis reactor 16. A heat medium gas 15 held at a high temperature (about 400° to 900°C) is blown into the pyrolysis reactor 16 so that the temperature of the liquid becomes about 350° to 500°C, and the pyrolysis reaction is performed at a pressure from about normal atmospheric pressure to 100 Kg/cm$^2$. An effluent 17 flowing from the pyrolysis reactor 16 enters a fractional distillation tower 21. The resulting residue 18 is withdrawn from the bottom of the pyrolysis reactor 16, and is cooled by a cooling device 19, after which the residue is discharged as a high aromatic residue 20. This residue is suitable as a powdery heat insulating material or binder. On the other hand, in the fractional distillation tower 21, the effluent 17 is fractionally distilled into a gas 22, an oil 23 having a boiling point of not more than about 200°C, and an oil 24 having a boiling point of above about 200°C. The gas 22 flows into the main gas pipe 12. The oil 23 passes into the oil tank 25, and the oil 24 having a boiling point of above about 200°C enters a heavy oil reservoir 26.

The decomposition oils in the oil tank 25 and the heavy oil reservoir 26 are mixed with hydrogen (circulating hydrogen 32 and replenishing hydrogen 27), pre-heated to about 300° to 400°C in a preheating furnace 28, and fed into a desulfurizing reactor 29 packed with a catalyst in order to desulfurize the oils. In the desulfurization reactor 29, the reaction is carried out at a temperature of about 300° to 400°C and a pressure of about 30 to 100 Kg/cm$^2$. The mixture 30 of the reaction product and hydrogen leaving the desulfurization reactor is passed through a hydrogen remover 31, where hydrogen is recovered. The hydrogen recovered is recycled through 32 to the reaction system after removal of $H_2S$, and a part of the hydrogen is used as a cooling hydrogen 33 for the desulfurizing reactor 29. After the removal of hydrogen, the reaction product is fed into a fractionating distillation column 34 where the reaction product is fractionally distilled into a gas 35 and a desulfurized oil 36. Thus, an oil 36 having a sulfur content of not more than about 0.3% by weight can be obtained. The gas 37 generated can be used as a fuel after desulfurization.

The following Examples are given to illustrate the present invention in greater detail. Unless otherwise indicated, all parts, percents, ratios, and the like are by weight.

EXAMPLE 1

The material used was a residual oil resulting from the distillation of Khafji crude oil at atmospheric pressure. The residual oil had a fixed carbon content of 11.6% by weight, a specific gravity ($d_4^{15}$) of 1.02, a boiling point (initial fraction) of 300°C, an end point (51% distilled) of 550°C, and a sulfur content of 4.36%. The residual oil was mixed with hydrogen, and pre-heated to 380°C. The pre-heated mixture was continuously introduced into a 370 cc reactor having an inside diameter of 20 mm and packed with 220 cc of a Co-Mo-Ni catalyst at its center. The reaction conditions employed were as shown in Table 1. 4 Kg of the reaction product was introduced into a reactor having an inside diameter of 130 mm and a height of 70 cm, and pyrolyzed by introducing steam preheated to a high temperature from a nozzle with an inside diameter of 3 mm, while maintaining the temperature of the liquid at a predetermined temperature. The pyrolyzing reaction conditions were as shown in Table 1. As a result, a gas, a distillation oil, and a residue were obtained.

The distillation oil obtained was mixed with hydrogen, and pre-heated to 380°C. The pre-heated mixture was continuously introduced into a 370 cc reactor having an inside diameter of 20 mm and packed with 220 cc of a Co-Mo catalyst at its center, and desulfurized. The desulfurizing reaction conditions were as shown in Table 1. As a result, an oil having a sulfur content of less than about 0.3% by weight could be obtained with the material balance shown in Table 1.

Table 1

| | Control (without) hydrogen treatment | Present Invention 1 | 2 | 3 | 4 |
|---|---|---|---|---|---|
| Hydrogen Treatment: | | | | | |
| Reaction Temperature (°C) | | 380 | 400 | 400 | 420 |
| Reaction Pressure (Kg/cm²) | | 100 | 100 | 150 | 150 |
| LHSV (l/H.l) | | 2.0 | 1.5 | 1.5 | 1.0 |
| Pyrolysis: | | | | | |
| Pyrolysis Temperature (°C) | 400 | 400 | 420 | 400 | 420 |
| Pyrolysis Time (minutes) | 165 | 180 | 75 | 210 | 82 |
| Pyrolysis Pressure (atms) | 1.0 | 1.0 | 1.0 | 1.0 | 1.0 |
| Steam Temperature (°C) | 700 | 700 | 700 | 900 | 500 |
| Desulfurization: | | | | | |
| Reaction Temperature (°C) | 380 | 380 | 380 | 400 | 400 |
| Reaction Pressure (Kg/cm².G) | 70 | 70 | 70 | 70 | 80 |
| LHSV (l/H.l) | 1.5 | 1.5 | 1.5 | 1.5 | 1.2 |
| Yield: | | | | | |
| Oil (S content wt% of not more than 0.3% by weight) vol% | 75.7 | 82.7 | 84.6 | 87.5 | 91.3 |
| | 85.8 | 93.8 | 95.9 | 97.3 | 102 |
| Residue (wt%) | 19.3 | 12.1 | 10.0 | 6.99 | 3.04 |
| Gas (wt%) | 4.99 | 5.20 | 5.40 | 5.51 | 5.46 |
| Composition of Gases Generated (wt%): | | | | | |
| $H_2$ | 0.39 | 0.31 | 0.28 | 0.30 | 0.19 |
| $CH_4$ | 11.4 | 9.57 | 8.90 | 8.57 | 5.44 |
| $C_2$ - $C_3$ | 21.4 | 18.0 | 16.7 | 16.1 | 10.3 |
| $C_4$ - | 10.7 | 8.99 | 8.35 | 8.04 | 5.12 |

Table 1-continued

| | Control (without) hydrogen treatment | Present Invention 1 | 2 | 3 | 4 |
|---|---|---|---|---|---|
| $H_2S$ | 56.2 | 63.1 | 65.7 | 67.0 | 78.9 |

EXAMPLE 2

The material used was a residual oil resulting from the distillation of Khafji crude oil at reduced pressure. The residual oil obtained had a fixed carbon content of 18.6% by weight, a specific gravity ($d_4^{15}$) of 1.037, a needle penetration degree of 80 to 100, and a sulfur content of 5.64% by weight. The residual oil was treated in the same manner as in Example 1. The reaction conditions and the results obtained are shown in Table 2.

Table 2

| | Control (without) hydrogen treatment | Present Invention 1 | 2 | 3 |
|---|---|---|---|---|
| Hydrogen Treatment: | | | | |
| Reaction Temperature (°C) | | 375 | 400 | 430 |
| Reaction Pressure (Kg/cm²) | | 100 | 150 | 150 |
| LHSV (l/H.l) | | 2.0 | 1.0 | 0.5 |
| Pyrolysis: | | | | |
| Pyrolysis Temperature (°C) | 400 | 400 | 420 | 400 |
| Pyrolysis Time (minutes) | 165 | 180 | 8.5 | 200 |
| Pyrolysis Pressure (atms) | 1.0 | 1.0 | 1.0 | 1.0 |
| Steam Temperature (°C) | 900 | 700 | 500 | 900 |
| Desulfurization: | | | | |
| Reaction Temperature (°C) | 380 | 380 | 400 | 400 |
| Reaction Pressure (Kg/cm².G) | 70 | 70 | 70 | 80 |
| LHSV (l/H.l) | 1.5 | 1.5 | 1.5 | 1.2 |
| Yield: | | | | |
| Oil (S content wt% of not more than 0.3% by weight) vol% | 61.3 | 72.8 | 80.3 | 82.7 |
| | 70.6 | 83.8 | 92.6 | 95.2 |
| Residue (wt%) | 31.0 | 20.7 | 11.6 | 8.36 |
| Gas (wt%) | 7.69 | 6.50 | 8.10 | 8.94 |
| Composition of Gases Generated (wt%):- | | | | |
| $H_2$ | 0.52 | 0.33 | 0.25 | 0.23 |
| $CH_4$ | 15.1 | 9.65 | 7.30 | 6.61 |
| $C_2$ - $C_3$ | 28.3 | 1.82 | 13.7 | 12.4 |
| $C_4$ - | 14.2 | 9.05 | 6.86 | 6.22 |
| $H_2S$ | 41.9 | 62.8 | 71.9 | 74.5 |

While the invention has been described in detail and with reference to specific embodiments thereof, it will be apparent to one skilled in the art that various changes and modifications can be made therein without departing from the spirit and scope thereof.

What is claimed is:

1. A process for preparing a low sulfur content fuel oil in a high yield from atmosphere pressure distillation or vacuum distillation residual oils of crude oils, which comprises:

1. treating said atmospheric or vacuum distillation residual oil with hydrogen at a temperature of about 35° to 450°C and a pressure of about 50 to 200 Kg/cm² at a liquid hourly space velocity of about 0.2 to 4 1/H·1 in the presence of a hydrogenation catalyst to produce a treated oil, 2. separating the hydrogen gas from said treated oil and contacting it with steam held at about 400° to 900°C, and pyrolyzing the treated oil mixed with said steam at a temperature of about 350° to 500°C and a pressure of about atmospheric pressure to 100 Kg/cm² with a residence time of about 0.5 to 10 hours, and
3. hydrodesulfurizing the pyrolyzed oil at a temperature of about 300° to 400°C and a pressure of about 30 to 100 Kg/cm² at a liquid hourly space velocity of about 0.5 to 4 1/H·1 in the presence of a desulfurizing catalyst.

2. The process of claim 1, wherein the hydrogenation catalyst is a cobalt-molybdenum/alumina catalyst, a cobalt-molybdenum-nickel/alumina catalyst, or a platinum/alumina catalyst.

3. The process of claim 1, wherein the desulfurizing catalyst is a cobalt-molybdenum/alumina catalyst.

* * * * *